US009364384B2

(12) United States Patent
Van Den Driesche

(10) Patent No.: US 9,364,384 B2
(45) Date of Patent: Jun. 14, 2016

(54) ADJUSTABLE CRUTCH WITH AUTOMATED DEPLOYMENT

(71) Applicant: Kinovita, Soignies (BE)

(72) Inventor: Hugues Van Den Driesche, Soignies (BE)

(73) Assignee: KINOVITA, Soignies (BE)

( * ) Notice: Subject to any disclaimer, the term of this patent is extended or adjusted under 35 U.S.C. 154(b) by 0 days.

(21) Appl. No.: 14/204,154

(22) Filed: Mar. 11, 2014

(65) Prior Publication Data

US 2014/0251397 A1 Sep. 11, 2014

Related U.S. Application Data

(63) Continuation of application No. 13/368,500, filed on Feb. 8, 2012, now abandoned.

(51) Int. Cl.
*A61H 3/02* (2006.01)

(52) U.S. Cl.
CPC ..... *A61H 3/02* (2013.01); *A61H 2003/0272* (2013.01); *A61H 2201/0161* (2013.01); *A61H 2201/0192* (2013.01); *A61H 2201/1215* (2013.01); *A61H 2201/149* (2013.01); *A61H 2201/50* (2013.01); *A61H 2201/5038* (2013.01); *A61H 2201/5048* (2013.01)

(58) Field of Classification Search
USPC ..... 135/69, 75
See application file for complete search history.

(56) References Cited

U.S. PATENT DOCUMENTS

| | | | | |
|---|---|---|---|---|
| 3,157,189 | A | 11/1964 | Farnham | |
| 4,625,742 | A | 12/1986 | Phillips | |
| 5,281,900 | A | 1/1994 | Park | |
| 5,282,486 | A | 2/1994 | Hoover | |
| 5,973,618 | A * | 10/1999 | Ellis | A61H 3/061 135/75 |
| 6,708,831 | B1 | 3/2004 | Balassi | |
| 7,918,237 | B1 | 4/2011 | Kuo et al. | |
| 8,397,737 | B2 | 3/2013 | Evans et al. | |
| 8,418,704 | B1 | 4/2013 | Teeters | |
| 2005/0103373 | A1 * | 5/2005 | Heiss et al. | 135/100 |
| 2008/0029140 | A1 | 2/2008 | Turner | |
| 2010/0186789 | A1 | 7/2010 | Vegvary | |
| 2011/0061698 | A1 | 3/2011 | Iwata | |
| 2012/0167933 | A1 * | 7/2012 | Vegvary | 135/69 |

FOREIGN PATENT DOCUMENTS

| | | | | |
|---|---|---|---|---|
| DE | 4137466 | A1 * | 5/1993 | A61H 3/02 |
| WO | WO 99/00101 | | 1/1999 | |

* cited by examiner

*Primary Examiner* — Noah Chandler Hawk
(74) *Attorney, Agent, or Firm* — Jacobson Holman PLLC

(57) ABSTRACT

A variable-length crutch 1 has a main body 2, a foot 5 extensible and retractable with respect to the main body 2, and an actuator, which actuator involves a motor 6, a rotary output shaft 9, an irreversible worm transmission converting rotation of the motor shaft 9 into linear movement of the foot 5 with respect to the main body 2, a sensor 10 for extending the foot 5 with respect to the main body 2, and a programmable module 8 connected to the motor 6 to control extension and/or retraction of the crutch to a preprogrammed length and to stop the motor 6 when the length is reached.

16 Claims, 1 Drawing Sheet

ADJUSTABLE CRUTCH WITH AUTOMATED DEPLOYMENT

Figure 1:
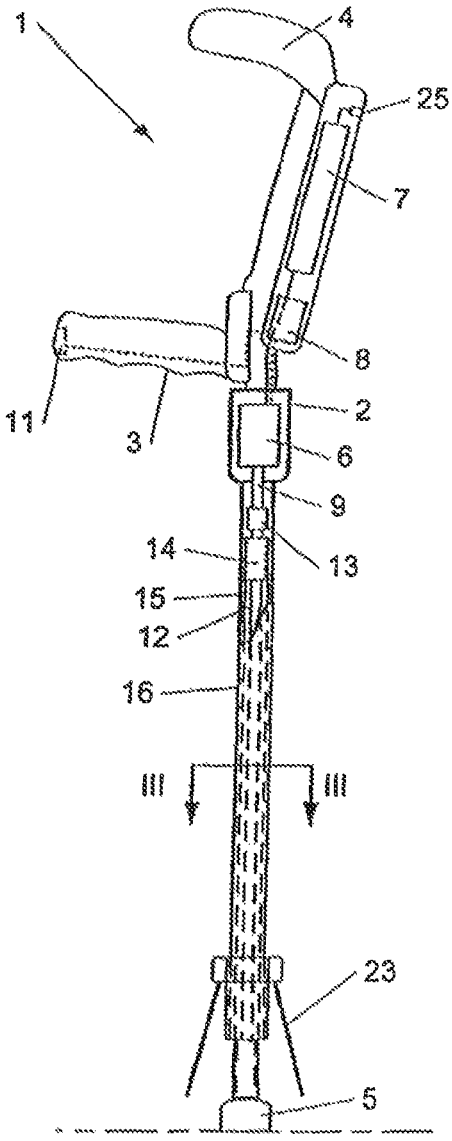

This is a continuation of application Ser. No. 13/368,500 filed Feb. 8, 2012, the disclosures of which are incorporated herein by reference.

The present invention relates to a variable-length crutch comprising a main body, a foot that is extensible and retractable with respect to said main body, and an actuator comprising a motor with a rotary output shaft and worm transmission for converting a rotation of said motor shaft into a linear movement of said foot with respect to the main body.

Such a variable-length crutch was described in the international patent application WO 99/00101. In this crutch of the prior art, the extension or retraction of the crutch is controlled by simple switches. End-of-travel switches stop the motor when the actuator arrives at the end of travel. When the motor is stopped, a brake must be activated to maintain the desired position of the crutch.

Such an arrangement does however include certain disadvantages. First of all, only the end-of-travel positions are clearly defined, and the user cannot easily stop the deployment of the crutch on a precise intermediate position. Given in particular that crutches are often used in pairs, and that normally the two crutches must be adjusted over the same length with a certain precision, the personalization of the crutch will therefore require the movement of the end-of-travel switches, which is a complicated operation. In addition, the brake introduces an additional mechanical element that may constitute a source of breakdowns. However, reliable functioning is one of the most important criteria of use for a crutch.

One object of the present invention is therefore to provide a variable-length crutch affording precise positioning and reliable locking in any intermediate position in the deployment travel thereof.

With this object, in a variable-length crutch according to the present invention, the worm transmission is irreversible, and the actuator also comprises a programmable module controlling the motor, said module being connected to said motor in order to control the extension and/or retraction of the crutch to a preprogrammed length and to stop the motor when said length is reached.

By virtue of the programmable control module and the extension sensor, the extension and/or retraction of the crutch can be controlled and stopped at at least one position that is easily programmable with great precision. By virtue of the irreversible character of the worm transmission, the foot of the crutch then remains locked reliably at this preprogrammed position, independently of the bearing force exerted on the foot of the crutch. Apart from the innovative ergonomics thereof, the crutch has innovative handling particularities. It also has the specificity of being a tool for dynamic assistance in lifting.

Preferably, the programmable control module can be an electronic module, able to comprise a specialized logic circuit or a generalist processor.

Preferably, said module can comprise a touch and/or voice user interface connected to said control module to enable the user to control said extension and/or retraction of the crutch. "Touch interface" means mainly control buttons. "Voice interface" means any device that can react to sound signals emitted by the user.

Preferably, said motor may be electric and the actuator also comprises an electrical energy source. Such a motor offers advantages both through its low weight and bulk and through the precision of the control thereof. Even more preferably, said electrical energy source may be formed by at least one rechargeable battery, and optionally also comprise a socket for recharging said batteries.

Preferably, the crutch of the invention may also comprise a first tube and a second tube, the foot being fixed to the first tube, the second tube being fixed to the main body, and the first and second tubes being mounted telescopically with respect to each other. Thus the first and second tubes can form a telescopic sheath serving in particular to protect the worm transmission.

Preferably, said worm transmission may comprise a threaded rod coupled to the motor shaft, a nut secured to the foot and engaged on said threaded rod, and a linear guide for preventing the rotation of the nut with respect to the main body, while enabling linear movement thereof. In this way a worm transmission is obtained with great robustness and limited size. However, alternative worm transmission arrangements could be considered by a person skilled in the art according to circumstances. Even more preferably, the nut may be made from synthetic material. A nut made from synthetic material reduces the friction of the worm transmission and helps to dampen shocks.

Preferably, the crutch of the invention can also comprise an interface for programming said control module.

Preferably, the crutch of the invention can also comprises a is support that can be fixed to the foot in order to keep the crutch upright without requiring any other support.

Preferably, the main body of the crutch of the invention can comprise a handle and a support for the forearm or armpit.

The invention also relates to a method of using such a crutch, in which said control module activates the motor for extending and/or retracting the crutch to a preprogrammed length and stops the motor when said length is reached, and this length is then maintained in the face of axial forces by said irreversible worm transmission.

Advantageously, a user can bear on the folded crutch in order to pass from a seated position to a standing position, and then proceed to control, through said control module, the deployment of the crutch so as to rest thereon for walking. As the deployment length of the crutch is controlled automatically, the user can use it in this way without making any particular effort to adjust the deployment length on each occasion.

Advantageously, said control module can activate the motor by transmitting to it a number of pulses proportional to the distance between an initial length and said preprogrammed length. In this way, the control module can regulate the extension and/or retraction of the crutch in open loop without requiring a position sensor.

Advantageously, the control module can regulate the speed of said motor by width modulation of said pulses. Thus the speed of extension and/or retraction of the crutch can be varied according to the circumstances.

In particular, the speed of the motor could be reduced progressively on approaching said preprogrammed length and/or progressively increased during an initial step of the extension and/or retraction of said crutch in order to avoid stopping and/or starting shocks that could damage the crutch actuator.

Details concerning the invention are described below with reference to the drawings.

Figure 3:
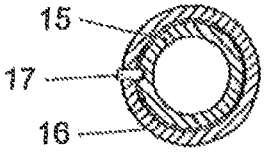
Figure 2:
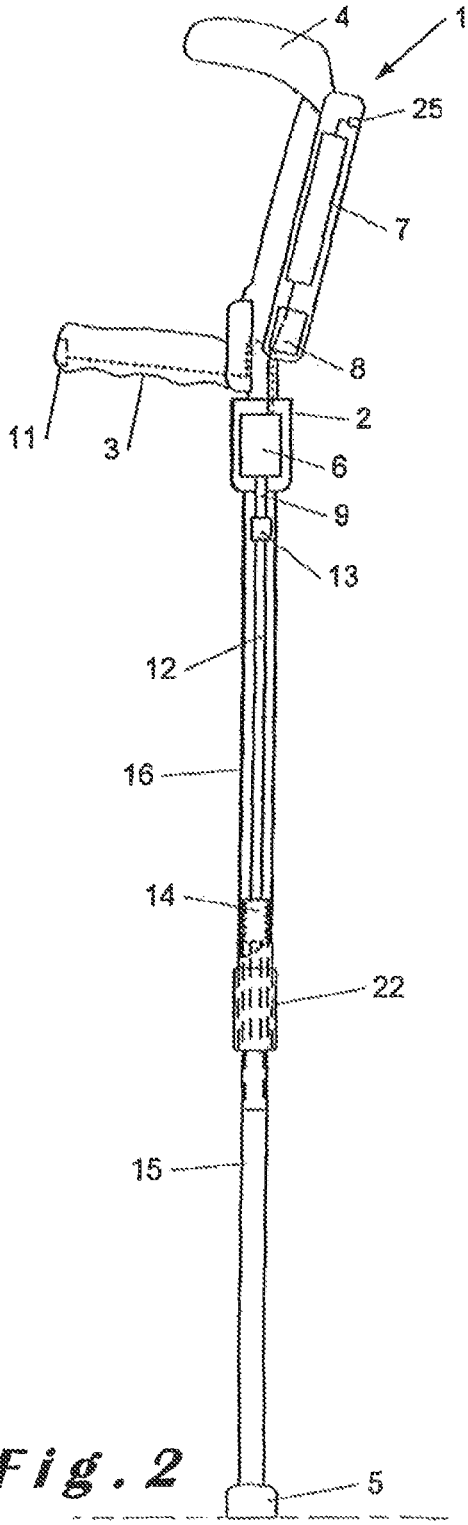

FIG. 1 shows a crutch according to one embodiment of the invention in the retracted position, FIG. 2 shows the crutch of FIG. 1 in the deployed position, and FIG. 3 shows a transverse section of the crutch of FIG. 1 in the plane III-III.

A variable-length crutch 1 comprising a main body 2 with a handle 3 and a support for the forearm 4, and a foot 5, is shown in the folded position. In this position, the crutch enables persons of reduced mobility to help themselves to get up from a seated position to a standing position by bearing on the crutch 1, the length thereof in this position being able to provide maximum support for the user.

Once the user is in the standing position, he can trigger an automatic extension of the crutch 1 in order to arrive at a deployed position such as the one illustrated in FIG. 2. In this deployed position, the crutch 1 can be used conventionally to support the standing user.

Both the length of the crutch 1 in the folded position and the length in the deployed position can be adapted to each individual user. For this purpose, the crutch 1 has an actuator with, in the main body 2, an electric motor 6 supplied by rechargeable batteries 7 and controlled by an electronic programmable control module 8 connected to a touch control interface in the form of push buttons 11 placed on the handle 3.

In a preferred embodiment, the rechargeable batteries are two 8.4 V batteries connected in series, the motor 6 is a brushless motor developing a nominal torque of 16 mNm, and the module 8 controls the motor by a pulse width modulation (PWM) signal. The rotation angle of the motor is thus determined by the number of pulses transmitted by the module 8, while the rotation speed is inversely proportional to the duration (width) of the individual pulses. The crutch 1 also comprises an electric socket 25 for recharging the batteries 7.

The motor shaft 10 is coupled to a threaded rod 12 through a coupling 13. This coupling 13 is rigid and without clearance. This threaded rod 12 is in engagement with a nut 14, thus forming a worm transmission, the materials and pitch of which are chosen so that it is irreversible, that is to say an axial force on the nut 14 cannot cause an appreciable rotation of the threaded rod 12, although a rotation force on the threaded rod 12 does indeed cause an axial movement of the nut 14.

The nut 14 is coupled to the foot 5 through a first hollow tube 15. This first tube 15 is mounted telescopically with respect to a second tube 16 fixed to the main body 2 of the crutch. In order to prevent rotation of the nut 14, of the first tube 15 and of the foot 5 with respect to the main body 2 when the threaded rod 12 turns, the first tube 15 comprises a longitudinal groove in engagement with a screw 17 fixed radially to the second tube 16, so as to form a linear guide, as illustrated in FIG. 3. Thus, when the crutch 1 is in a folded position, as illustrated in FIG. 1, a simple pressure on a button 11 can activate the motor 6, turning the threaded rod 12 so as to deploy the first tube 15 and the foot 5 to a deployed position with respect to the main body 2, as illustrated in FIG. 2. When the user wishes to fold the crutch 1, another pressure on the button 11 can activate the motor 11 in the reverse direction, turning the threaded rod 12 so as to fold the first tube 15 and the foot 5 to the folded position with respect to the main body 2. At the start of each movement, the module 8 demands, by PWM, a progressive acceleration of the speed of the motor 6, in order to avoid starting shocks.

Both the folded position and the deployed position can be programmed in the module 8, so that the module 8 controls the stooping of the motor 6 when arriving in one or other position. However, in the preferred embodiment, the folded position is indicated by a fixed end-of-travel stop. In the preferred embodiment the module 8 controls a progressive reduction in the speed of the motor 6 when approaching one or other position, acting like an electronic brake for preventing shocks and reducing wear on the actuator. In addition, one or more intermediate positions can also be preprogrammed in the module 8, so as to simplify further the adaptation thereof to different users. In order to protect the actuator, the module 8 can also be programmed to stop the motor 6 if a load beyond a preprogrammed threshold is detected, such as for example an axial force of 20 N on the rod. This overload could be detected through the electrical supply to the motor or, alternatively, by an axial load sensor installed in the axial bearing of the rod.

In the preferred embodiment, the threaded rod 12 is made from brass and has an M8 thread with a 2 mm pitch. It is coupled rotatably to the motor shaft 10 by a steel coupling 14 and supported axially by an antilock assembly with integral spring, with an intermediate washer made from synthetic material, for example polyimide, as an axial bearing. The nut 14 is also made from synthetic material, for example polyacetal, and the tubes 15 and 16 from an aluminum alloy such as the one designated AW-AlMgSi in accordance with the standard EN 6060. In this preferred embodiment, the first tube 16 has an inside diameter of 15.70 mm, an outside diameter of 18.70 mm and a length of 460.00 mm+/−0.5 mm. The second tube 16 has an inside diameter of 18.80 mm, an outside diameter of 22.00 mm and a length of 460.00 mm+/−0.5 min. In this preferred embodiment, the first tube 15 therefore telescopes in the second tube 16. Both the external surface of the first tube 15 and the internal and external surfaces of the second tube 16 are treated by passivation.

On its bottom end, the threaded rod 12 also has a block 19 made from synthetic material, such as polyacetal, for the internal lateral support of the first tube 15. On its bottom end, the second tube 16 has an adjustable sleeve 22 for the external lateral support of the first tube 15. A supplementary support 23, for example of the tripod type, can be mounted, optionally detachably, on the sleeve 22, in order to be able to hold the crutch 1 upright, when it is in the folded position, without any other support. The support 23 may be a support unfolding laterally when the crutch 1 reaches a folded position.

In this embodiment, the foot 5 is a foot made from elastomer material, such as rubber, mounted detachably on the bottom end of the first tube 15, so as to allow access to the inside of the actuator.

Although the present invention has been described with reference to specific example embodiments, it is obvious that various modifications and changes can be made to these examples without departing from the general scope of the invention as defined by the claims. For example, the crutch can also comprise a more complex interface, or a data connection, to enable the programming of the control module to be modified. Consequently, the description and drawings must be considered in an illustrative rather than restrictive sense.

The invention claimed is:

1. A variable-length crutch (1) comprising a) a main body (2), b) a foot (5) extensible an retractable with respect to the main body (2), and c) an actuator including i) a motor (6) with a rotary output shaft (9) and ii) a worm transmission for converting rotation of the motor shaft into linear movement of the foot with respect to the main body and comprising a threaded rod (12) coupled to the motor shaft (9) and a nut (14) engaged on the threaded rod (12), the nut (14) being coupled to the foot (5) through a first hollow tube (15) mounted telescopically with respect to a second tube (16) fixed to the main body (2), wherein the first tube (15) comprises a longitudinal groove engaged with a screw (17) fixed radially to the second tube (16), so as to form a linear guide preventing rotation of the nut (14), the first tube (15), and the foot (5) with respect to the main body (2) when the threaded rod (12) turn, and d) an electric programmable control module (8) for controlling the motor (6), the module (8) being connected to the motor (6) in order to control the extension and/or retraction of the crutch (1) to one or more lengths preprogrammed into, and under the control of, the module and to stop the motor (6) when the length is reached and being operable for providing progressive acceleration of the speed of the motor (6) at the start of each movement in order to avoid starting shocks.

2. The crutch (1) of claim 1, wherein the module (7) comprises a touch user interface connected to the control module (8) to enable the user to control the extension and/or retraction of the crutch (1).

3. The crutch (1) of claim 1, wherein the motor (6) is electric and the actuator also comprises an electrical energy source.

4. The crutch (1) of claim 3, wherein the electrical energy source is formed by at least one rechargeable battery (7).

5. The crutch (1) of claim 4, wherein the electrical energy source also comprises a socket (25) for recharging the at least one battery (7).

6. The crutch (1) of claim 1, wherein the nut (14) is made from synthetic material.

7. The crutch (1) of claim 1, further comprising an interface for programming the control module (8).

8. The crutch (1) of claim 1, further comprising a support (23) that can be fixed to the main body (2) in order to keep the crutch (1) upright on the foot (5) in the folded position without requiring any other support.

9. The crutch (1) of claim 1, wherein the main body (2) comprises a handle (3) and a support (4) for the forearm or armpit.

10. The crutch (1) of claim 1, wherein the progressive acceleration of the speed of the motor is controlled by a pulse width modulation signal.

11. A method of using the crutch (1) of claim 1, comprising the steps of activating the motor (6) by the control module for extending and/or retracting the crutch (1) to a preprogrammed length, stopping the motor (6) by the control module when the length is reached, and maintaining the length in the face of axial forces by the worm transmission.

12. The method of claim 11, wherein a user bears on the folded crutch (1) in order to pass from a seated position to a standing position, and next proceeds, through the control module (8), to control the extension of the crutch (1) to the preprogrammed length so as to rest thereon in order to walk.

13. The method of claim 11, wherein the control module (8) activates the motor (6) by transmitting thereto a number of pulses proportional to the distance between an initial length and the preprogrammed length.

14. The crutch of claim 1 wherein the motor is a brushless motor.

15. The crutch (1) of claim 1, wherein the module comprises a voice user interface connected to the control module (8) to enable the user to control the extension and/or retraction of the crutch (1).

16. The crutch (1) of claim 1, wherein the programmable control module (8) is operable for providing a progressive reduction of the speed of the motor (6) when approaching the end of each movement.

* * * * *